US007146832B2

(12) United States Patent
Mathofer

(10) Patent No.: US 7,146,832 B2
(45) Date of Patent: Dec. 12, 2006

(54) ACTUATING DEVICE FOR DOORS OR HATCHES OF VEHICLES

(75) Inventor: Reinhold Mathofer, Wülfrath (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 144 days.

(21) Appl. No.: 11/031,681

(22) Filed: Jan. 7, 2005

(65) Prior Publication Data

US 2005/0178176 A1 Aug. 18, 2005

(30) Foreign Application Priority Data

Jan. 14, 2004 (DE) ..... 10 2004 001 894

(51) Int. Cl.
*E05B 13/10* (2006.01)

(52) U.S. Cl. ..... 70/208; 70/370; 70/451; 292/336.3; 292/DIG. 31

(58) Field of Classification Search ..... 70/208, 70/210, 224, 370, 371, 451, 466; 292/336.3, 292/DIG. 31, DIG. 53
See application file for complete search history.

(56) References Cited

U.S. PATENT DOCUMENTS

| | | | | |
|---|---|---|---|---|
| 2,040,258 | A * | 5/1936 | Jacobi | 70/370 |
| 6,401,302 | B1 * | 6/2002 | Josserand et al. | 292/336.3 |
| 6,415,636 | B1 * | 7/2002 | Fukumoto et al. | 70/208 |
| 6,494,066 | B1 * | 12/2002 | Muneta | 70/208 |
| 6,523,379 | B1 * | 2/2003 | Teskey | 70/371 |
| 6,748,775 | B1 * | 6/2004 | Bucker et al. | 70/208 |
| 6,834,901 | B1 * | 12/2004 | Low | 292/336.3 |
| 2002/0124606 | A1 * | 9/2002 | Muneta | 70/208 |

FOREIGN PATENT DOCUMENTS

| | | |
|---|---|---|
| DE | 30 30 519 | 2/1982 |
| DE | 199 50 172 | 4/2001 |
| EP | 1 026 351 | 8/2000 |

* cited by examiner

*Primary Examiner*—Brian E. Glessner
*Assistant Examiner*—Christopher Boswell
(74) *Attorney, Agent, or Firm*—Friedrich Kueffner

(57) ABSTRACT

In an actuating device, the turret is installed in a carrier and removed from it by a setting movement. The setting movement comprises a plug-in phase and a shift phase during the installation procedure. Thus a shoulder on the turret arrives behind an opposing shoulder on the carrier. A locking screw secures the installed turret on the carrier. A rocker arm is supported pivotably on the carrier, which rocker arm has a control curve and a thrust surface and which can be pivoted between a starting position and an end position. In addition, the carrier is provided with a slide, which can also be shifted between a release position and locking position. Upon moving into the locking position, blocking surfaces on the slide arrive behind the opposing blocking surface on the turret. During the installation of the turret, the turret pushes against the thrust surface of the rocker arm and pivots the rocker arm toward its end position. During the removal of the turret, the thrust surface of the rocker arm ensures that the turret is pushed back in the carrier until the shoulder and the opposing shoulder release each other.

18 Claims, 9 Drawing Sheets

ACTUATING DEVICE FOR DOORS OR HATCHES OF VEHICLES

BACKGROUND OF THE INVENTION

1. Field of the Invention

The present invention relates to an actuating device.

2. Description of the Related Art

A so-called "turret" can hold either a real lock cylinder or a dummy cylinder for the sake of styling. A turret of this type is usually mounted in the carrier and removed from it again from the outside of the door only after the carrier has been attached to the inside of the door. This is done by a setting movement of the carrier, which consists of two different, successive components. The first phase of the setting movement required to install the turret is a "plug-in" phase, during which the turret is inserted into an opening in the carrier. This is followed by a "shift phase", in which the inserted turret is subjected to a parallel shift in the carrier. During this parallel shift in the opening in the carrier, at least one lateral shoulder on the turret arrives behind an opposing shoulder on the carrier. A locking screw is then used to lock the turret in its installed position in the carrier.

The turret is removed from the carrier in the reverse manner. First, the locking screw is loosened. Then the shift phase of the setting movement is performed in reverse, during which the opposing shoulder on the carrier releases the shoulder on the turret. Now the "pull-out" phase of the setting movement can be performed, during which the turret is pulled out of the opening in the carrier.

In an actuating device of this type (DE 30 30 519 A1), the turret is held in the carrier merely by the shoulder or shoulders. After installation, the shoulders grip the opposing shoulders in the carrier. The ability of the installed turret to resist being pulled out, however, is unsatisfactory. The threaded receptacle for the locking screw is located in the carrier, and the end of this screw merely prevents the turret from being parallel-shifted in the reverse direction in the carrier, which must be done before the turret can be removed. The locking screw does not make any contribution to the ability of the turret to resist being pulled out of the carrier.

In an actuating device of a different type (EP 1 026 351 A1), the two sidepieces of a U-shaped slide are guided in lateral guide rails of a carrier. A threaded hole for a setscrew is provided in the web connecting the two sidepieces of the "U". The head of this screw points toward the interior of the yoke, whereas the end of the screw which is used to actuate the screw projects laterally from the carrier. This actuating end of the setscrew is accessible through a lateral opening in the rabbet area of the door. When the setscrew is turned, the head of the screw meets a side wall of the turret, which has been inserted into an opening in the carrier, and as the screw continues to be turned, it pushes the U-shaped slide toward the rabbet of the door. In this phase, projections seated on the two U-sidepieces at the web end travel into corresponding recesses in the turret, the goal of which is to make it impossible to pull the turret out of the carrier. No setting movement is performed to install the turret. The pull-out resistance of the turret, which is clamped between the projections on the U-shaped slide and the head of the adjusting screw, is unsatisfactory.

SUMMARY OF THE INVENTION

The invention is based on the task of developing an actuating device of the type indicated above which includes a turret with greater resistance to being pulled out of the carrier and which prevents unauthorized persons from performing manipulations which could allow removal of the turret.

In accordance with the invention, the rocker arm pivotably supported in the carrier has several functions. According to the first function, the control curve provided on the rocker arm moves a slide, which is guided with freedom of movement on the carrier, out of a locking position, in which at least one blocking surface on the slide is engaged with an opposing blocking surface on the turret, into a release position, in which the blocking surface on the slide releases the opposing surface on the turret. According to the second function, the thrust surface provided on the rocker arm shifts the turret back in the carrier to such an extent that the shoulder on the turret releases the opposing shoulder on the carrier, this movement thus constituting a reversal of the shift phase of the original setting movement. It is now possible, of course, to pull the turret easily out of the carrier in a manner which represents a reversal of the plug-in phase of the setting movement originally performed during the installation procedure. The rocker arm performs its third function during the installation of the turret. During the plug-in phase, the turret comes in contact with the thrust surface and thus pivots the rocker arm out of its starting position and toward its end position. The rocker arm then in fact reaches this end position upon completion of the parallel shift phase of the turret in the carrier. Because of the functions performed by the rocker arm, the turret can be installed in the carrier very easily and quickly, and it can be removed from the actuating device again with equal ease and speed. In the device according to the invention, the turret has surprisingly strong resistance to being pulled out of the carrier.

When the actuating end of the rocker arm is positioned on the rear surface of the carrier, opposite the handle, manipulations by unauthorized persons designed to remove the turret from the inventive device are made more difficult. The rocker arm is located on the inside of the door and is therefore virtually inaccessible to unauthorized persons. Only after the door has been opened are the openings accessible, through which a tool such as a screwdriver could be inserted to pivot the rocker arm. Only an authorized person, i.e., a person who has a key which fits the lock cylinder in the turret, can open the door. The inventive device makes a vehicle thus equipped theft-proof; unauthorized persons are prevented from gaining access to the interior of the vehicle.

In the inventive actuating device, as previously mentioned, the turret is highly resistant to pull-out because of the presence of several locking mechanisms. A first locking mechanism is present between the shoulder(s) on the turret and corresponding opposing shoulder(s) on the carrier. A second locking mechanism is provided by the blocking surface or surfaces on the slide and associated opposing blocking surfaces on the turret. The direction of movement of the slide out its release position, in which the blocking and opposing blocking surface are disengaged, into the locking position, in which the blocking surfaces are engaged, is accomplished not only in the same direction but also in the same direction as that in which the turret moves in the carrier during the shift phase of the setting movement by which the turret is installed in the carrier.

The locking screw has the purpose of securing the slide in its locked position on the carrier. Once this is done, the secured state is present in which the turret remains installed reliably in the carrier no matter how strong the pull-out forces may be. The locking screw does not serve to shift the slide in the carrier between the release position and the locking position. As previously mentioned, it is the inventive rocker arm which is used to shift the slide.

Although the control curve on the rocker arm could also be used to move the slide back in the opposite direction, i.e., from its release position into the locking position, it is simpler with respect to design to provide spring loading between the slide and the carrier for this purpose. This spring loading tries to move the slide into the locking position. This is done automatically.

The spring-loading of the slide can also take care of pivoting the rocker arm via the control surfaces back into its end position, in which the inserted turret is in its set installation position and the slide is in its locking position. Conversely, when the rocker arm is pivoted back manually, in opposition to the spring-loading and then left in the starting position thus reached, the slide will be in its release position and the turret will be in an intermediate phase of its setting movement, in which the turret needs merely to be plugged into or pulled back out of the carrier.

The various features of novelty, which characterize the invention, are pointed out with particularity in the claims annexed to and forming part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE INVENTION

Figure 2:
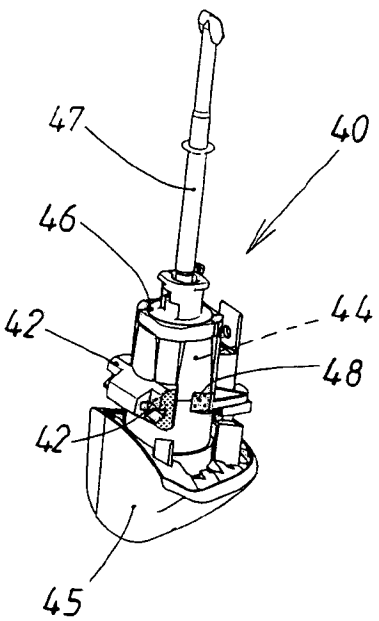
FIG. 2 is a perspective view of a second component of the actuating device, namely, a turret, which is to be mounted in the device according to FIG. 1.
Figure 1:
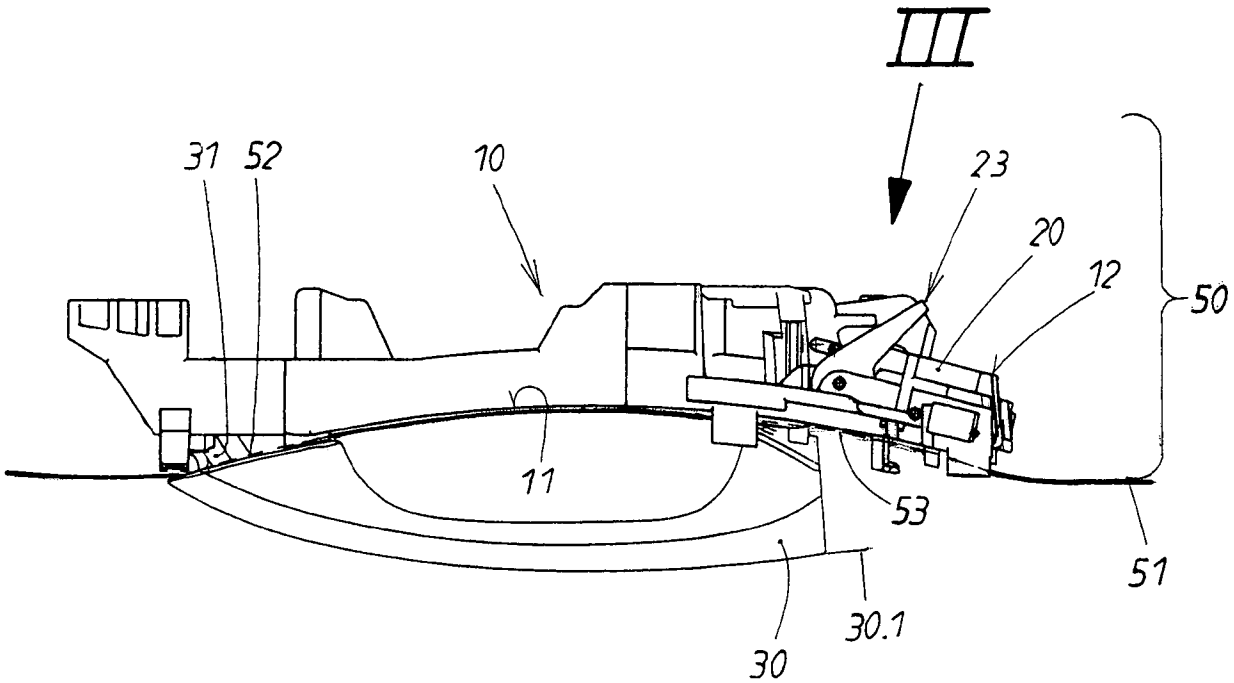
FIG. 1 shows a side view of the actuating device, one of the components of which, namely, the carrier, is already attached to the door, where the course of the outer panel of the door is illustrated, and where a handle belonging to the actuating device has been mounted from the outside surface of the door and supported in the carrier.

As can be seen from FIGS. 1 and 2, the actuating device consists of a carrier 10 with a slide 20, connected to it to form a single component; a handle 30; and a turret 40. The carrier 10 is attached to the interior of the door 50 from the inside surface of the door, which is not shown in detail. The slide 20 is guided with freedom of longitudinal movement on the rear surface 12 of the end section of the carrier 10, as will be described later in more detail. The exterior panel 51 of the door 50 rests against the front surface 11 of the carrier. So that the handle 30 and the turret 40 can be installed, the exterior panel 51 of the door is provided with two openings 52, 53.

The handle 30 is introduced from the outside surface of the door 50 through the openings 52, 53 into the carrier 10. For this purpose, the handle has at one end a bearing end 31, which is passed through the one opening 52 and hooked onto a bearing block in the carrier 10 (not shown). In this exemplary embodiment, the handle 30 is a pull-type handle, which, when actuated as illustrated by the arrow 34 in FIG. 4, can be moved from the rest position 30.1 shown in dash-dot line in FIG. 4 and shown in solid line in FIG. 1, into an actuating position 30.2. At the other end of the handle is an arc-shaped arm 32, on the end of which a driver 33 is located. The arm 32 with the driver 33 is introduced through the previously mentioned second opening 53 in the exterior door panel 51. In the installed position according to FIGS. 1–4, the driver 33 fits behind the initial element (not shown) of a linkage, which leads to a lock. The lock is installed in the door 50 and can be opened by the previously described actuation 34 of the handle 30, when the lock is in the released state. The lock cannot be opened by the handle 30, however, when the lock is in its locked state. The switching of the lock between the locked state and the released state is accomplished by the use of a key, which actuates a lock cylinder and/or by a central locking device in the vehicle.

Figure 10:
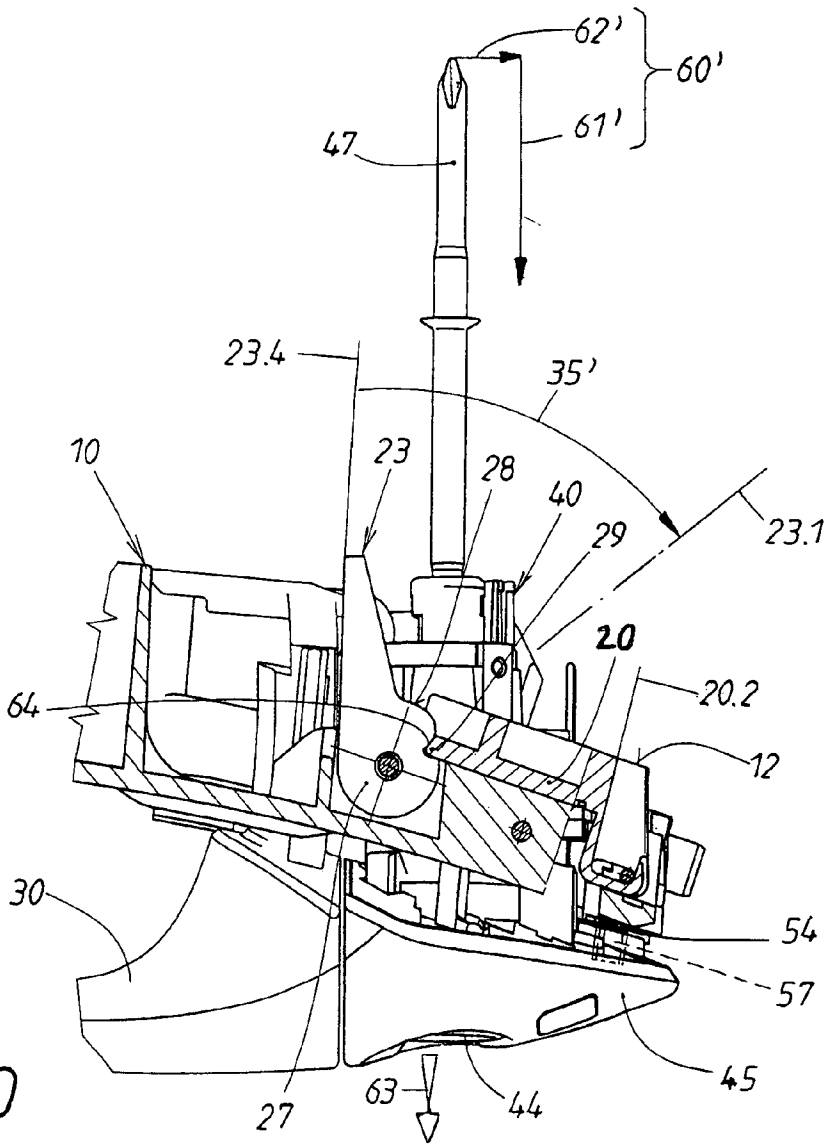
FIG. 10, similar to FIG. 4, is a "sprung" longitudinal sectional view through the completely assembled actuating device of FIG. 8 along the cross-sectional line X—X of FIG. 9, the outer door panel having been omitted.

A lock cylinder 44 of this type can be installed in the turret 40 and, as shown in FIG. 10, accessed from the outside of the door in the area of the head 45 of the turret. The lock cylinder 44 is enclosed by a cylindrical housing 46, out of which, as FIG. 2 shows, a flexible shaft 47 projects. The shaft 47 is connected to the output end of the lock cylinder and is turned during the previously mentioned actuation process by a key assigned to the lock cylinder 44. The shaft 47 acts on the previously mentioned lock in the door 50. As a result of actuation by the key, the lock is shifted as desired between a locked and a released position.

Figure 3:
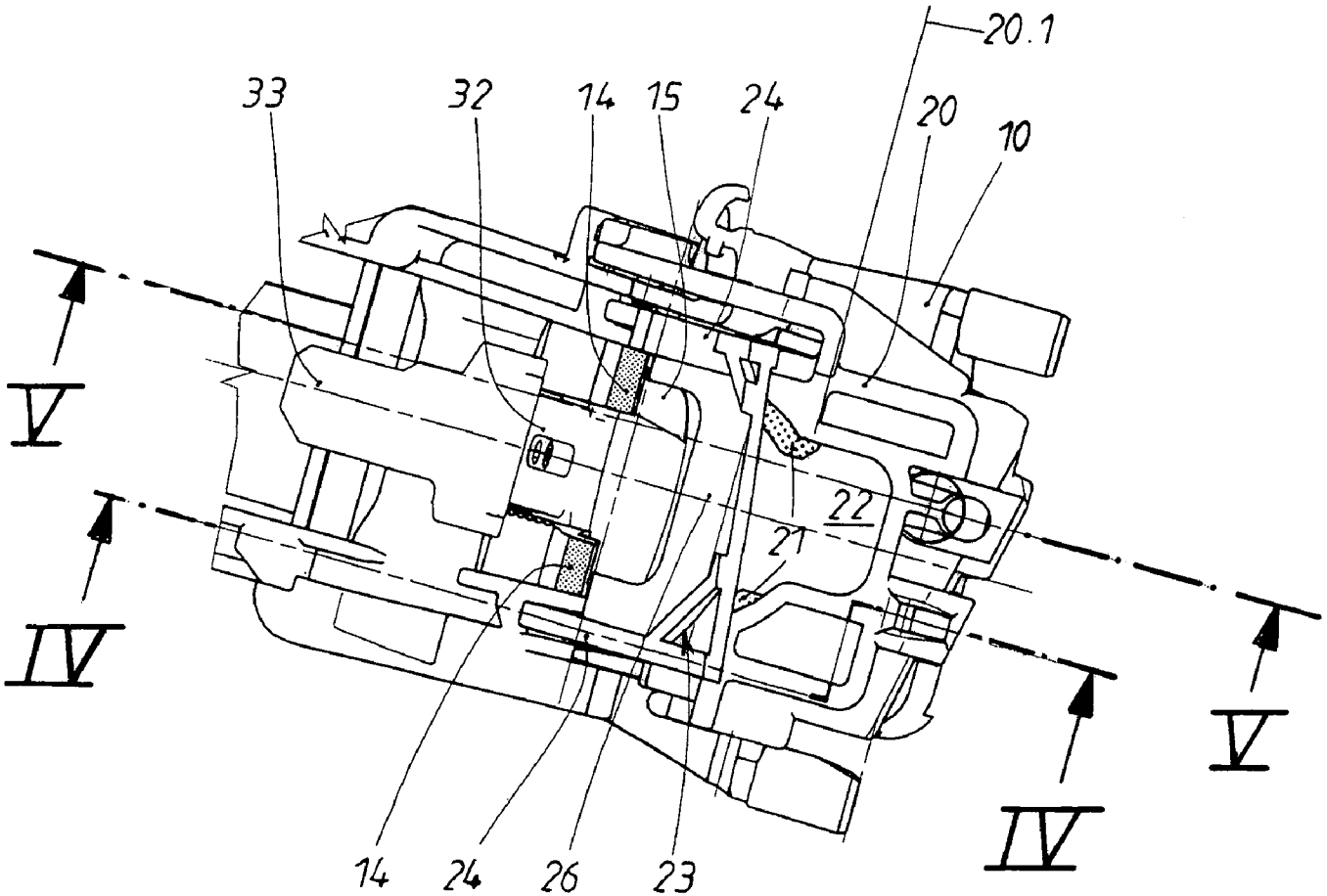
FIG. 3 is a perspective, rear view of the carrier of FIG. 1, looking in the direction of the arrow III in FIG. 1.
Figure 4:
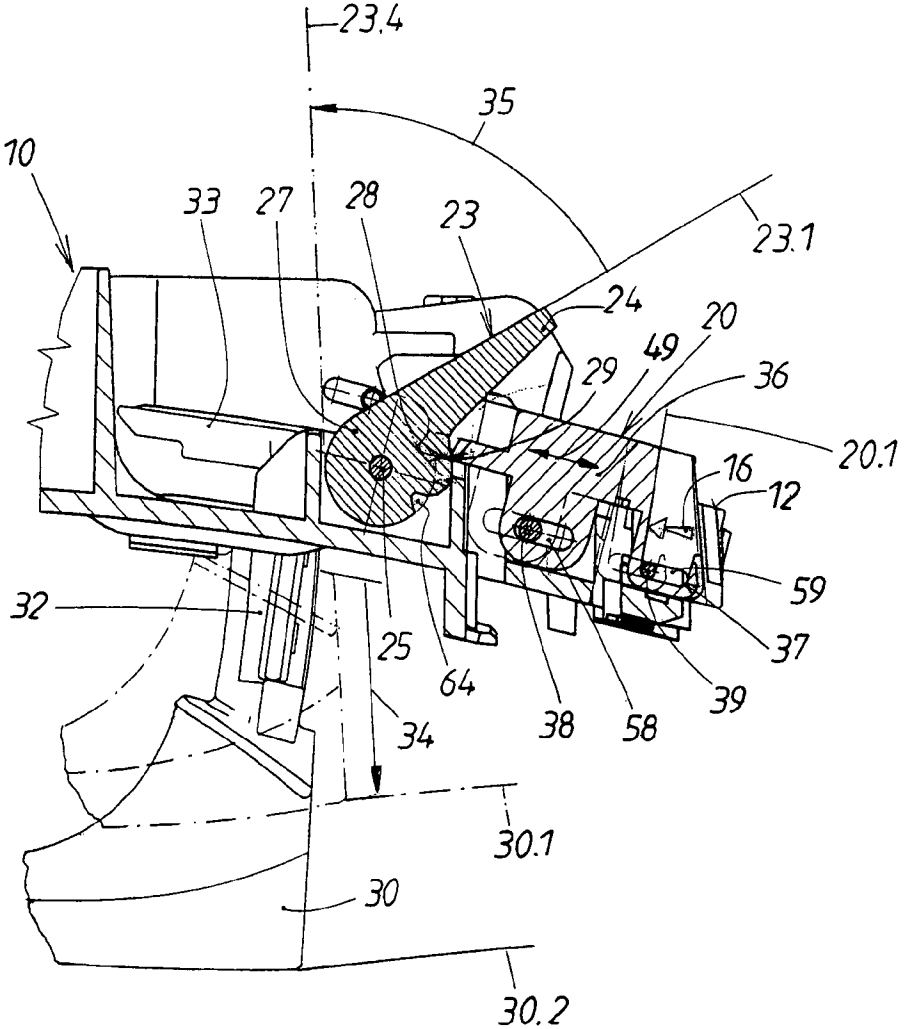
FIG. 4 is a longitudinal section through the carrier of FIG. 3 along the "sprung" cross-sectional line IV—IV, where the handle has been actuated to simplify the following installation of the turret.

As can best be seen in FIGS. 3 and 4, a U-shaped rocker yoke 23 is supported in the carrier. The two sidepieces 24 of the yoke are seated on a common pivot axis 25 in the carrier 10. Between the two yoke sidepieces 24 there is an opening 15 in the carrier 10, which is used for the installation of the turret 40 in a manner to be described later in more detail. A web extends between the two sidepieces 24 of the U-shaped rocker yoke 23. In FIGS. 1–5, the rocker yoke 23 is located in a starting position, illustrated by the auxiliary line 23.1 in FIG. 4, where a thrust surface 26, located in the area of the web, as FIG. 3 shows, partially closes off the opening 15 in the carrier. As can be derived from FIG. 4, at least one of the two sidepieces 24 has a control cam 27 in the area of the axle 25; the circumferential profile of this cam forms a defined control curve 28. The control curve 28 works together with an opposing control surface 29 on the slide 20. The control curve 28 and the opposing control surface 29 work non-positively together. A spring could be installed between the carrier 10 and the slide 20, although this is not done in the present exemplary embodiment of the invention. In an alternative exemplary embodiment, however, such a spring could act in the direction of arrow 16 of FIG. 4 to apply force to the slide 20.

When the rocker yoke 23 is in its starting position 23.1 shown in FIGS. 1–5, the slide 20 is held in a first of two positions, which is to be called the "release position" for reasons which will become clear later on. As can be seen in FIG. 3, the slide 20 has a cut-out area 22, which produces the shape of a "U" when the slide is viewed from above. The cut-out area 22 coincides at least partially with the previously mentioned opening 15 in the carrier 10. The slide 20 has special blocking surfaces 21 on the two inside edges of its cut-out area 22; these surfaces lie outside the carrier opening 15 when the slide is in the release position 20.1. This makes it possible to install the turret 40 in the carrier 10.

Figure 5:
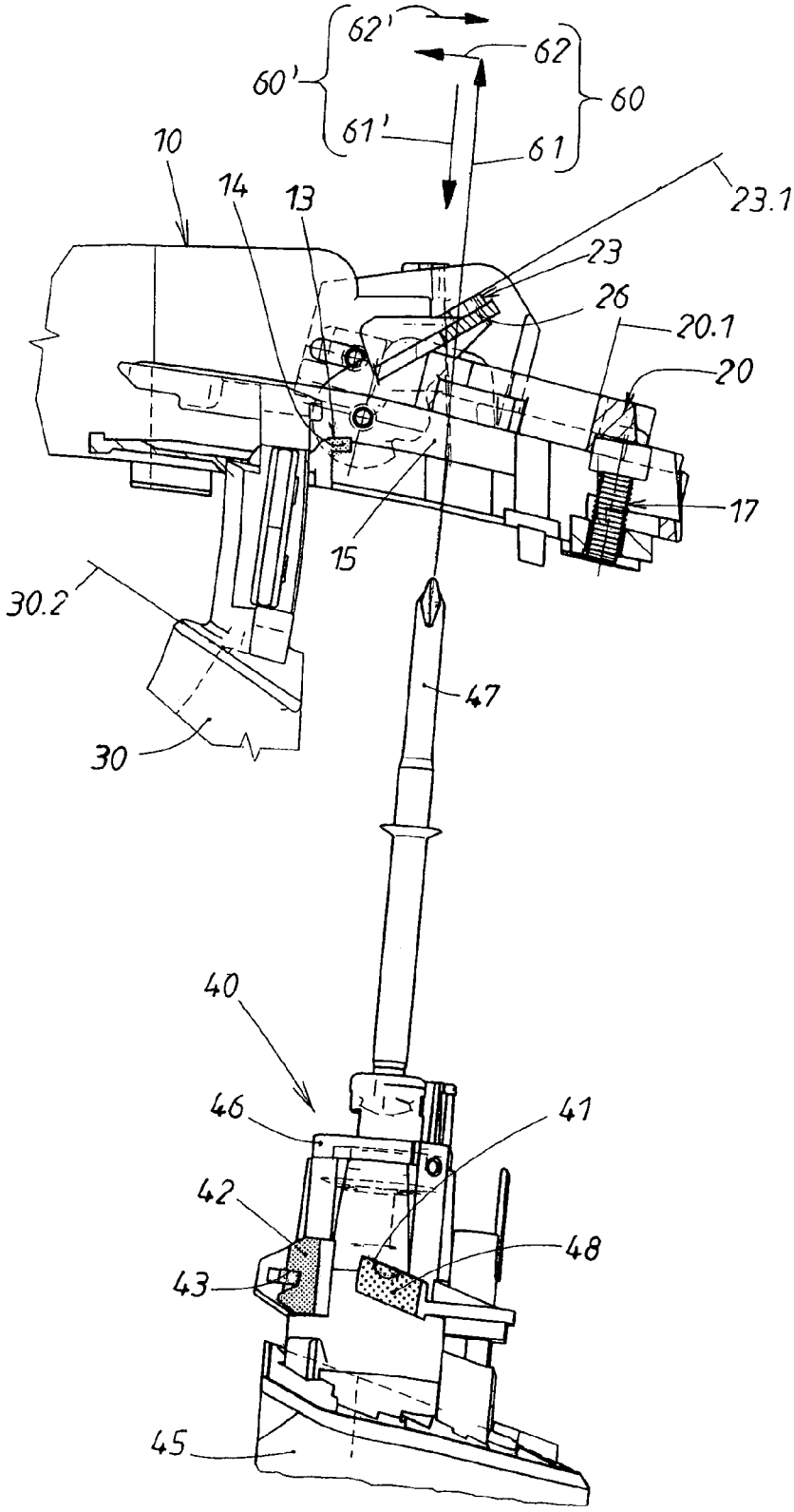
FIG. 5 is another longitudinal section through the carrier of FIG. 3 along the "sprung" cross-sectional line V—V of FIG. 3, where the turret of FIG. 2 is shown at the beginning of the setting movement during its installation in the carrier.

The installation of the turret 40 in the carrier is illustrated in chronological sequence in. FIGS. 5–8. The installation proceeds by way of a setting movement 60, which, as can be seen by the arrows in FIG. 5, is divided into two components 61, 62. The first component of the movement is a "plug-in" phase, illustrated by the arrow 61 in FIG. 5, in which the shaft 47 and housing 46 of the turret are inserted from the outside surface of the door into the carrier opening 15. This is followed by the "shift phase", illustrated by the arrow 62 in FIG. 5, where the turret 40, now plugged in as far as its head 45, is shifted sideways along the carrier in a direction essentially parallel to itself.

Figure 6:
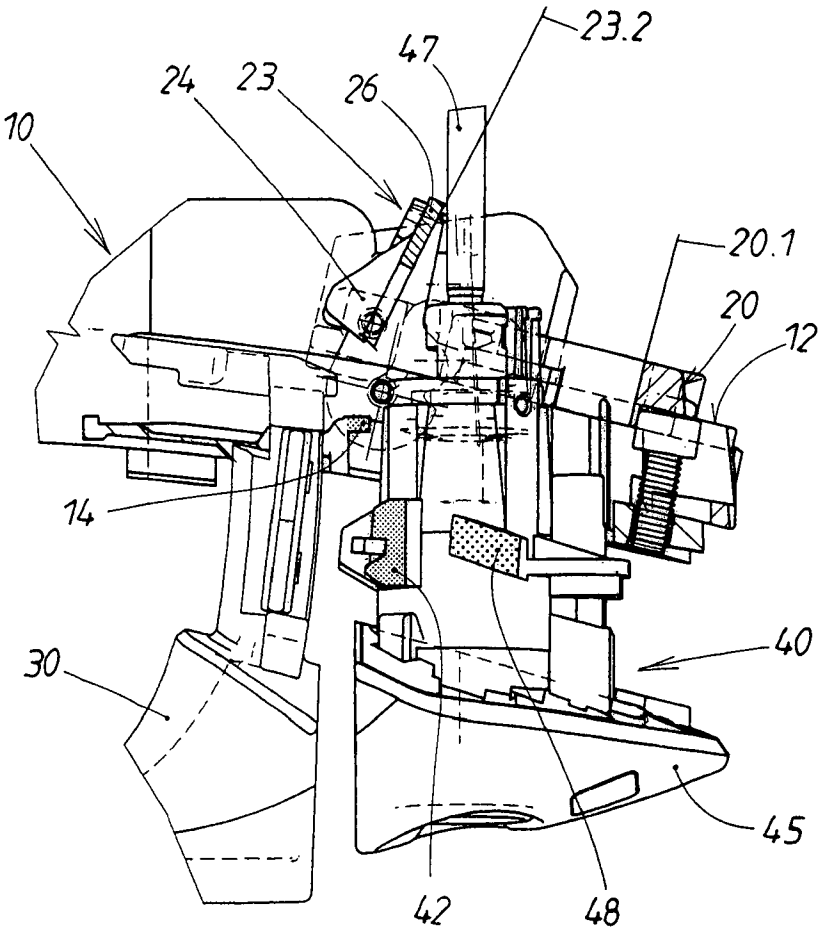
FIGS. 6 and 7 are cross-sectional side views similar to those of FIG. 5 of two additional phases of the setting movement performed during the installation of the turret.
Figure 7:
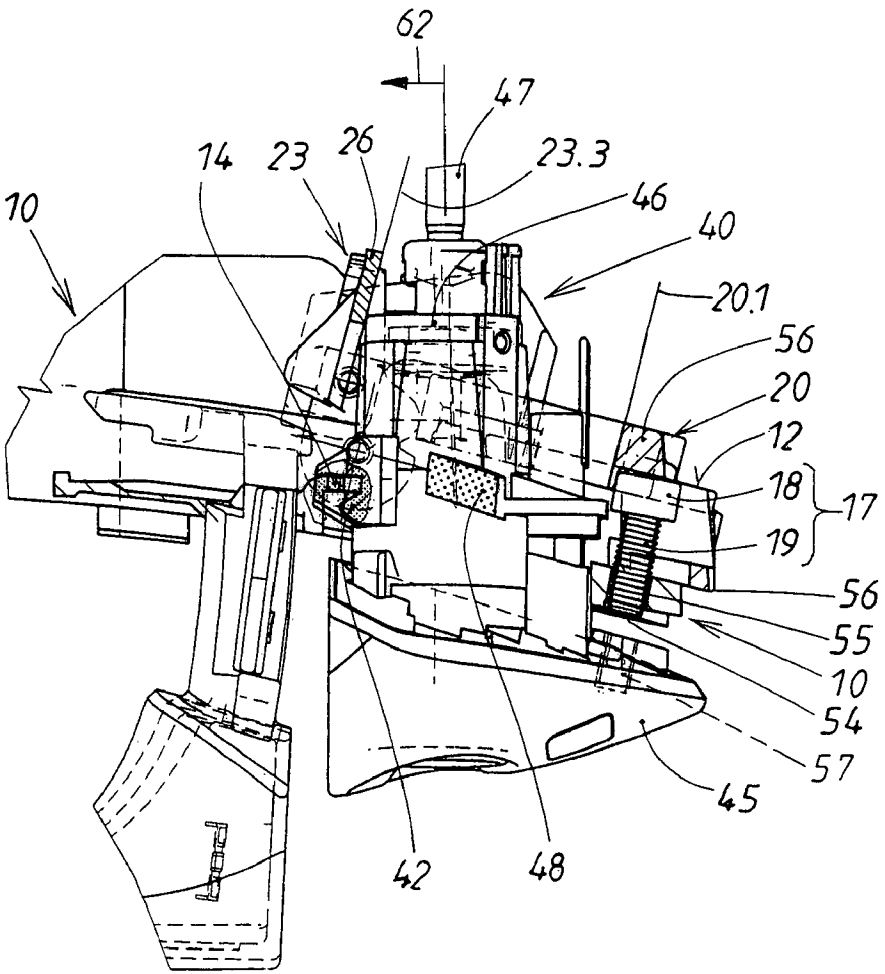

During the plug-in phase 61, the end of the shaft 47 makes contact with the previously mentioned thrust surface 26 of the rocker yoke 23. This has the result that the rocker yoke 23 begins to pivot out of its starting position 23.1 of FIG. 3 into various intermediate positions 23.2 and 23.3, as can be seen in FIGS. 6 and 7, which show the successive stages. The shaft 47 itself is able to produce the intermediate position 23.2 of FIG. 6, whereas the intermediate position 23.3 of FIG. 7 has been produced by the inward travel of the cylinder housing 46, which pushes aside the thrust surface 26 of the rocker yoke 23. The plug-in phase 61 is essentially complete in FIG. 7. The shift phase 62 of FIG. 7 can now begin.

As can be seen in FIG. 2 and especially clearly in FIG. 5, the turret 40 has two radial projections 42, one on each side of its cylindrical housing 46, each of which is provided with a transversely oriented indentation. This is illustrated by the dotted shading in the drawings. The flank of the indentation facing in the direction opposite the plug-in direction 61 forms a shoulder 43, which is best seen in FIG. 5. To this shoulder 43, according to FIG. 5, is assigned a projection 14 on the carrier 10, as also emphasized by dotted shading, which projection also has an opposing shoulder 13 facing in the direction opposite the plug-in direction 61. Upon completion of the plug-in phase according to FIG. 7, the projection 14 of the carrier 10 is more-or-less aligned with the indentation in the projection 40.

When the previously mentioned shift phase 62 is now performed, the projection 14 travels into the indentation in the radial projection 42. It is obvious that, because there are two radial projections 42, there are also two projections 14 on the carrier, made as mirror images of each other, which is especially clear in FIG. 3. In the engaged position, which is present in FIGS. 8–10 but which cannot be seen in detail there, the two projections 14 are engaged in the indentations in the two radial projections 42. As a result, the shoulders 43 of the turret 20 grip the opposing shoulders 13 of the carrier 10.

When an unauthorized person, i.e. a person who does not have a key, wants to gain access to the interior of the vehicle and must therefore break open the door 50, the first step is to unlock one of the door locks, which is in its locking position. The thief can gain access to the lock by force, namely, by tearing the turret 40 axially out according to the force arrow 63 shown in FIGS. 8 and 10. This is opposed by the interlocking engagement between the previously mentioned turret shoulders 43 and the opposing carrier shoulders 13. The pull-out force 63 is transmitted via the shoulders 43 and the opposing shoulders 13 to the carrier 10, from which it is then absorbed by the door. This engagement at 43, 13, however, is also supported by yet another engagement.

As previously mentioned in conjunction with FIG. 3, the slide 20 is provided with two facing blocking surfaces 21, which, in the previously described release position 20.1 of the slide 20, which is present in FIGS. 1–7, are still a certain radial distance away from the turret 40 to be inserted. Two opposing surfaces 41 on the turret are assigned to the blocking surfaces 21 on the slide, as can be seen in FIG. 5. These turret blocking surfaces 21 are formed by two recesses 48 on opposite sides of the cylinder housing, which are emphasized by the dotted shading in the figure. When, as described, during the plug-in phase 61, the rocker yoke 23 leaves its starting position 23.1, the control curve 28 of its control cam 27 also leaves the opposing control surface 29 of the slide 20. Then the slide 20 can also leave its previous release position 20.1 and approach the other position 20.2, which can be seen in FIGS. 8–10, which characterizes a "locking position" of the slide 20. The slide 20 can be shifted either manually or automatically by means of the spring loading 16 mentioned previously in conjunction with FIG. 4. The slide 20 can follow, in succession, the pivoting movement of the rocker arm 23 illustrated by the motion arrow 35 in FIG. 4.

During the shift phase 62 of the turret 40 described in conjunction with FIG. 7, finally, the rocker yoke 23 arrives in its end position 23.4, illustrated in dash-dot line in FIG. 4 and concretely in FIG. 10. As FIG. 10 shows, the slide 30 has remained in contact with the control curve 28 of the rocker yoke control cam 27, and, when the end of the control curve 28 is reached, the opposing control surface of the slide travels into a notch 64 in the control cam 27, visible in FIG. 4, and latches itself in position there. The crucial point here is that the previously mentioned two blocking surfaces 21 of the slide 20 arrive behind the opposing blocking surfaces 41 on the turret 40 and therefore make a significant contribution to the locking of the turret in the carrier 10. The latter situation is especially easy to see in FIG. 9

Figure 8:
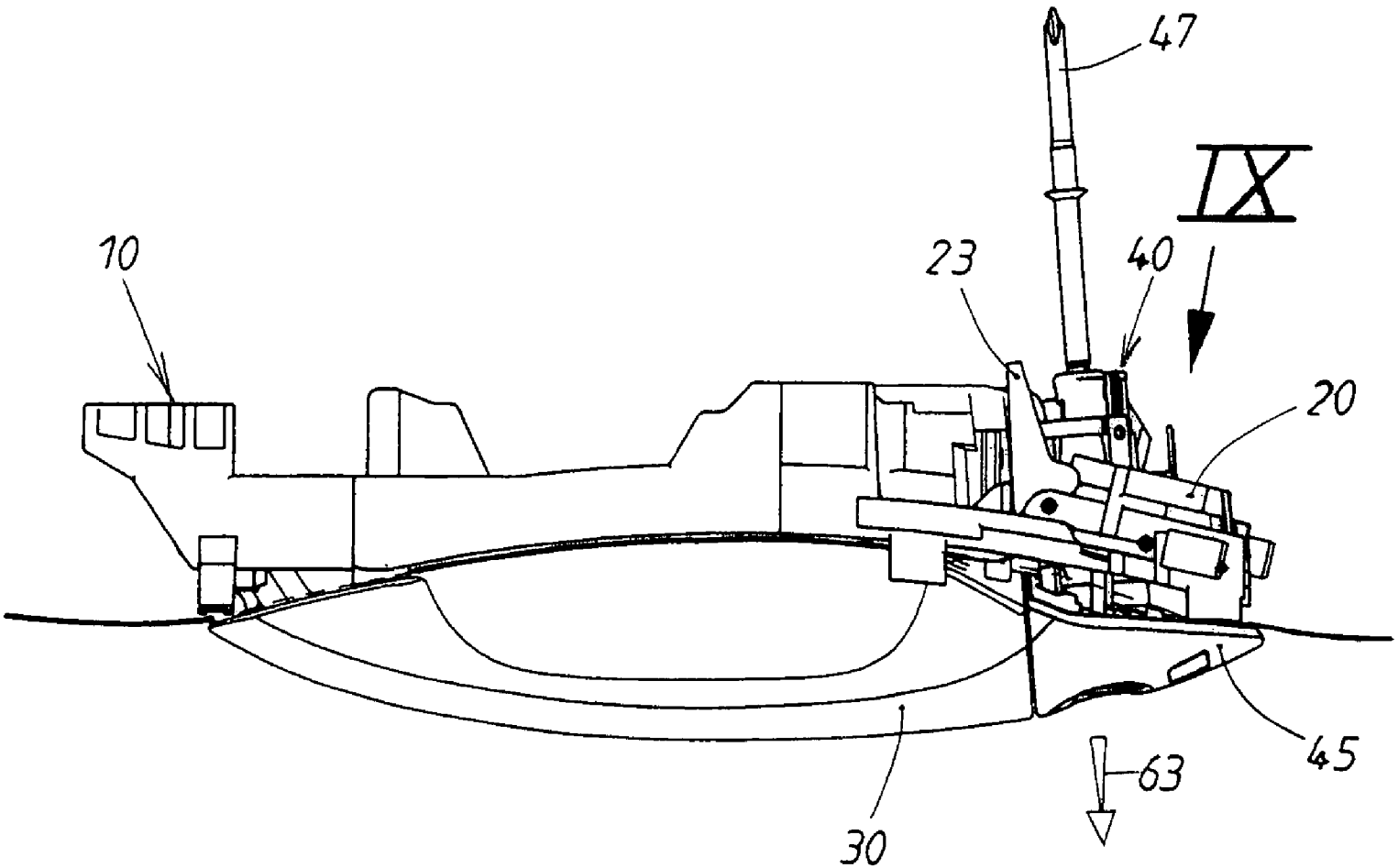
FIG. 8 is a view similar to that of FIG. 1 of the finished actuating device, in which the turret is installed in the carrier.
Figure 9:
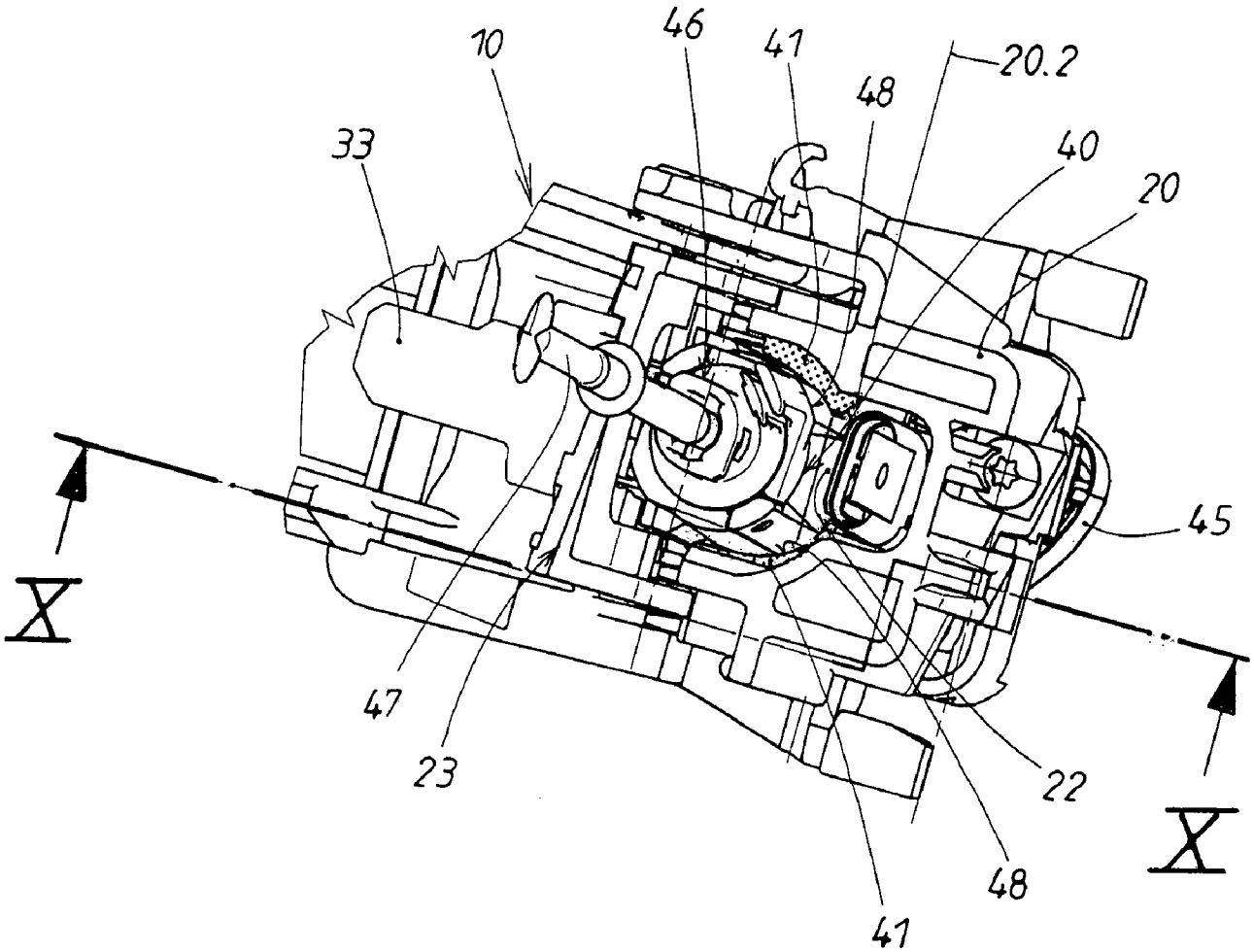
FIG. 9 is a perspective view from the rear of the finished actuating device of FIG. 8, looking in the direction of the arrow IX in that figure.

In the final assembly position according to FIGS. 8–10, the turret 40 is held with optimal strength in the carrier 10. A double engagement is present: first, between the two last-mentioned slide blocking surfaces 21 and the opposing turret blocking surfaces 41; and, second, between the previously mentioned two turret shoulders 43 and the opposing carrier shoulders 13. In addition, as already mentioned above, the slide 20 rests on the rear surface 12 of the carrier and slides along it. All of the material of the carrier is therefore available to reinforce the slide resting on its rear surface, which increases the resistance to the pull-out force 63.

As can be seen especially clearly in FIG. 4, the slide 20 is positioned reliably on the rear surface 12 of the carrier because it is connected to the carrier 10 by the retaining means 36–39. These retaining means include tongues 36, 37 on the carrier, which engage in corresponding openings in the carrier 10 and are secured in those openings by pins 38, 39. The pins 38, 39 fit into longitudinal guides in the tongues 36, 37. The pins 38, 39 are permanently positioned in the carrier. Because of this longitudinal guidance, the slide 20 is able to shift between its two positions 20.1 and 20.2, as shown by the arrow 49 in FIG. 4.

The locking position 20.2 according to FIGS. 8–10, finally, is secured by a locking screw 17, visible especially clearly in FIG. 7. In the present case, the screw shaft 19 is located in a hole 55 in the carrier, whereas its head-shaped actuating end is accessible from the rear surface 12 of the carrier. As long as the release position 20.1 of FIG. 7 is present, the shoulder 56 on the slide 20 extends over the actuating end 18 of the screw and prevents it from being turned. For the end 54 of the screw, a threaded bore 57 is provided in the head 45 of the turret. Before the completion of the shift phase 62, however, as illustrated in FIG. 7, this bore is still offset with respect to the end 54 of the screw.

But when the turret 40 is in its completely installed position according to FIG. 10, that is, after the shift phase 62 has been completed, the end, 54 of the screw is aligned with the threaded bore 57. Because the slide 20 is now also in its locking position 20.2, the shoulder 56 of the slide shown in FIG. 7 has also exposed the actuating end 18 of the screw, which cannot be seen in FIG. 10. Then, according to FIG. 10, the end 54 can be screwed into the threaded bore 57 in the head 56 of the turret. This threaded engagement also serves to increase the resistance to the pull-out force 63 acting on the installed turret 40.

An authorized person can remove the turret 40 quickly and conveniently. The order of the removal operations is the reverse of those previously described for installation. First, the locking screw 17 must be loosened. Because, as previously mentioned, the actuating end 18 is accessible only from the rear surface 12 of the carrier, the lock cylinder 44 must be actuated by means of the key in the possession of the authorized person, so that the door lock can be released. Then the handle 30 can be actuated in the direction of the arrow 34 of FIG. 4, as a result of which the door is opened. The actuating end 18 of the locking screw 17 can then be reached from the inside of the door.

After the locking screw 17 has released the head 45 of the turret, a reverse setting movement 60' according to FIG. 10 can be executed. This movement 60' is initiated by a manual reverse pivoting of the rocker yoke 23 in the direction of the pivot arrow designated by the number 35' in FIG. 10. Because of the previously mentioned latching of the opposing control surface 29 of the slide 20 in the notch 22 of the control cam 27, a certain force is required to accomplish this. In the process of the reverse pivoting 35', the rocker yoke reaches first the intermediate position 23.3 shown in FIG. 7, in which the thrust surface 26 visible there meets the cylinder housing 46 in the course of the reverse shift phase 62' illustrated in FIG. 10. As a result, the turret 40 is pushed away from the carrier projections 14 until the two opposing shoulders 13 on the carrier release the previously described turret shoulders 43. At the same time, the control cam 27 pushes the slide 20 so far back out of the locking position 20.2 of FIG. 10 toward the release position 20.1 that the slide blocking surfaces 21 also release their opposing blocking surfaces 41 in the turret 40. Now the turret 40 can be pulled out 61' by means of the reverse setting movement 60' illustrated in FIG. 10.

By pivoting the rocker arm 23 even more, the control surface 28 of the control cam 27 will continue to slide along the opposing control surface 29 of the slide 20 and will thus push the slide back until it reaches the complete release position 20.1 of FIG. 6. This is reached when the rocker arm 23 arrives in the starting position 23.1 illustrated in dash-dot line in FIG. 10 during its reverse pivoting movement 35'. Then the relationships according to FIG. 5 are present again; the turret 40 has been removed from the attached carrier.

I claim:

1. An actuating device for doors or hatches of vehicles, comprising a carrier, which can be attached to an interior of the door;

a turret, which has either a lock cylinder or a dummy cylinder for the sake of styling;

which turret can be installed in the carrier and/or removed from it by means of a setting movement;

wherein the setting movement of the turret has of two components, comprising, first, a plug-in phase for installation or a pull-out phase for removal, wherein the turret is inserted into or pulled out of an opening in the carrier; and second, a shift phase, proceeding transversely to the plug-in or removal direction, where the turret is subjected to a parallel shift in the carrier until at least one lateral shoulder on the turret arrives behind an opposing shoulder on the carrier during installation or moves away from the shoulder during the removal operation; and a screwable locking screw, which secures the installed turret in the carrier, wherein, in the carrier, a rocker arm is pivotably supported, which has both a control curve and a thrust surface, and which can be pivoted between a starting position and an ending position;

wherein, during the pivoting actuation of the rocker arm, the control curve shifts a slide, which is guided in the carrier, between two positions, namely, between a release position, representing the starting position of the rocker arm, in which a blocking surface on the slide releases an opposing blocking surface on the turret, and a locking position, representing the end position of the rocker arm, in which the blocking surface of the slide grips the opposing blocking surface and locks the turret in the carrier;

wherein, before the installation of the turret, the rocker arm is in its starting position and the slide is in its release position;

wherein, during the plug-in phase of the installation procedure, the turret pushes against the thrust surface and thus pivots the rocker arm toward its end position, which the rocker arm fully reaches after the turret has completed the shift phase in the carrier;

wherein, the locking screw secures the locking position of the slide on the carrier, whereupon the secured state is present, whereas, in the unsecured state, the locking screw releases the slide so that it is free to shift in the carrier;

so that, for removing the turret the rocker arm is pivoted manually back out of its end position, and where, first, the control curve of the rocker arm pushes the slide back toward the release position and, second, the thrust surface of the rocker arm pushes the turret back in the carrier to the point where the pull-out phase can begin.

2. The device according to claim 1, wherein the rocker arm and its actuating end are mounted on the rear surface of the carrier, this rear surface being opposite the front surface of the carrier, from which side the turret is plugged in during the installation operation.

3. The device according to claim 1, wherein the shift direction of the slide out of its release position into the locking position is the same as the direction of the parallel shift of the turret during the shift phase in the carrier, wherein, during installation, the shoulder on the turret travels behind the opposing shoulder on the carrier or, during the removal operation, leaves the opposing shoulder.

4. The device according to claim 1, wherein the rocker arm has a control cam, the circumferential profile of which forms a control curve; and wherein the slide has opposing control surfaces, which cooperate in by frictional engagement with the control curve of the rocker arm.

5. The device according to claim 4, wherein the control cam of the rocker arm has a notch, into which a leading piece of the slide travels as it moves into the locking position and which latches the rocker arm in its end position.

6. The device according to claim 1, wherein spring loading, which tries to push the slide out of its release position into its locking position, is provided between the slide and the carrier.

7. The device according to claim 5, wherein the spring loading of the slide tries to push the rocker arm back into its end position.

8. The device according to claim 1, wherein the slide rests on a rear surface of the carrier and slides on the rear carrier surface as it shifts position; and wherein the carrier material which creates the sliding surface increases the resistance of the slide to the pull-out forces which act on the turret during attempts to break out the locked turret.

9. The device according to claim 8, wherein the slide is connected by retaining means to the carrier.

10. The device according to claim 9, wherein the retaining means consist of at least one pin seated in the carrier, which pin engages in a guide in a tongue provided on the slide.

11. The device according to claim 1, wherein the rocker arm is a rocker yoke, which is pivotably supported jointly with two sidepieces thereof on the carrier; and wherein the opening in the carrier serving to accept the insertion of the turret is located between the two sidepieces of the yoke.

12. The device according to claim 11, wherein the control cam which acts on the slide when the rocker yoke is actuated is seated in the area of the bearing ends of the sidepieces.

13. The device according to claim 11, wherein the thrust surface by which the rocker yoke is pivoted during the installation of the turret and/or which pushes the turret back during the removal procedure is located in the area of the web of the rocker yoke.

14. The device according to claim 11, wherein the slide has two blocking surfaces located a certain distance laterally apart from each other, between which, in the locking position, the turret arrives with its two recesses, which form two opposing blocking surfaces.

15. The device according to claim 1, wherein the turret has two radial projections a certain distance apart, each with an indentation, one of the sidepieces of which forms the shoulder on the turret; and wherein two projections on the carrier are assigned to these indentations, these projections functioning as opposing shoulders during the installation and removal of the turret.

16. The device according to claim 1, wherein the carrier has a hole for the locking screw, the actuating end of which is on the rear surface of the carrier; and wherein the end of the screw opposite the actuating end is aligned with a threaded bore in the turret after the completion of the setting movement, whereupon the end can be screwed into the threaded bore.

17. The device according to claim 16, wherein the actuating end of the locking screw is inaccessible when the slide is in its release position but is accessible when the slide is in its locking position.

18. The device according to claim 1, wherein the slide has a hole for the locking screw; wherein the hole is aligned with another hole in the carrier when the locking position of the slide is present; and in that the end of the locking screw can be screwed into a threaded bore in the turret after the setting movement of the turret has been completed.

* * * * *